US009739095B2

(12) United States Patent
Seppala

(10) Patent No.: US 9,739,095 B2
(45) Date of Patent: Aug. 22, 2017

(54) DRILL BIT HAVING A SUNKEN BUTTON AND ROCK DRILLING TOOL FOR USE WITH SUCH A DRILL BIT

(71) Applicant: SANDVIK INTELLECTUAL PROPERTY AB, Sandviken (SE)

(72) Inventor: Conny Seppala, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 543 days.

(21) Appl. No.: 14/353,499

(22) PCT Filed: Oct. 23, 2012

(86) PCT No.: PCT/EP2012/070966
§ 371 (c)(1),
(2) Date: Apr. 23, 2014

(87) PCT Pub. No.: WO2013/060676
PCT Pub. Date: May 2, 2013

(65) Prior Publication Data

US 2014/0291035 A1 Oct. 2, 2014

(30) Foreign Application Priority Data

Oct. 27, 2011 (EP) ..... 11186861

(51) Int. Cl.

| | |
|---|---|
| ***E21B 10/46*** | (2006.01) |
| ***E21B 10/36*** | (2006.01) |
| ***E21B 10/56*** | (2006.01) |
| ***E21B 10/38*** | (2006.01) |

(52) U.S. Cl.
CPC ..... *E21B 10/56* (2013.01); *E21B 10/36* (2013.01); *E21B 10/38* (2013.01); *E21B 10/46* (2013.01)

(58) Field of Classification Search
CPC ..... E21B 10/38; E21B 10/36; E21B 10/46; E21B 10/56
See application file for complete search history.

(56) References Cited

U.S. PATENT DOCUMENTS

| | | | | |
|---|---|---|---|---|
| 3,185,228 A * | 5/1965 | Kelly, Jr. | ..... | E21B 10/56 175/415 |
| 3,346,060 A | 10/1967 | Beyer | | |
| 3,382,940 A * | 5/1968 | Stebley | ..... | E21B 10/40 175/426 |
| 3,955,635 A | 5/1976 | Skidmore | | |
| 4,106,578 A * | 8/1978 | Beyer | ..... | E21B 10/56 175/407 |

(Continued)

FOREIGN PATENT DOCUMENTS

| | | |
|---|---|---|
| WO | 0240820 A1 | 5/2002 |
| WO | 2005056972 A1 | 6/2005 |

*Primary Examiner* — Blake Michener
(74) *Attorney, Agent, or Firm* — Corinne R. Gorski

(57) ABSTRACT

A drill bit for percussive rock drilling tools includes a drill bit head having a front surface including a face surface defining a forward-most end of the drill bit head and at least one hole in the drill bit head for receiving a button. The drill bit includes at least one recess located in the face surface. The recess is larger than the hole. The hole is disposed in the recess so that an open end of the hole is disposed below the face surface. The drill bit head further includes a gauge surrounding the face surface, the recess being partially disposed in the gauge.

10 Claims, 4 Drawing Sheets

(56) References Cited

U.S. PATENT DOCUMENTS

| | | | | |
|---|---|---|---|---|
| 5,423,719 | A * | 6/1995 | Jennings | B23P 11/005 407/33 |
| 6,105,693 | A * | 8/2000 | Ingmarsson | E21B 10/36 175/414 |
| 6,276,467 | B1 * | 8/2001 | Ingmarsson | E21B 10/56 175/415 |
| 7,506,705 | B2 * | 3/2009 | Brandenberg | B22D 19/06 175/374 |
| 7,527,110 | B2 * | 5/2009 | Hall | E21B 10/36 175/415 |
| 8,567,533 | B2 * | 10/2013 | Myers | E21B 10/633 175/420.1 |
| 2004/0040752 | A1 | 3/2004 | Brandenberg et al. | |
| 2008/0087473 | A1 * | 4/2008 | Hall | E21B 10/56 175/414 |
| 2008/0164073 | A1 * | 7/2008 | Hall | A47C 3/00 175/432 |
| 2008/0210798 | A1 * | 9/2008 | Hall | A47C 3/00 241/294 |
| 2012/0125687 | A1 * | 5/2012 | Rives | E21B 10/43 175/57 |
| 2013/0180784 | A1 * | 7/2013 | Esko | E21B 10/36 175/415 |

* cited by examiner

DRILL BIT HAVING A SUNKEN BUTTON AND ROCK DRILLING TOOL FOR USE WITH SUCH A DRILL BIT

RELATED APPLICATION DATA

This application is a §371 National Stage Application of PCT International Application No. PCT/EP2012/070966 filed Oct. 23, 2012 claiming priority of EP Application No. 11186861/8, filed Oct. 27, 2011.

BACKGROUND AND SUMMARY

The present invention relates to drill bits for percussive rock drilling tools and, more particularly, to such drill bits that use hard buttons.

A known percussive drill bit with a plurality of inserts is disclosed in US 2008/087473. Further, another down-the-hole percussive hammer is disclosed in WO 02/40820.

In rock drilling applications devices such as down-the-hole hammer devices or rock drills that have drill bits with a plurality of buttons mounted thereon are often used. The buttons can be made of a material such as cemented carbide that is harder than the material from which the body of the drill bit is made. At the forward end of the drill bit, the front surface of the drill bit head on which the buttons are mounted is ordinarily formed to have a central area that shall be denominated for purposes of the present discussion as a face surface and a surrounding, frustoconical area that is typically referred to as a gauge or a gauge surface. One or more flow openings ordinarily extends through the length of the drill bit and leads to a flow channel formed in the front surface of the drill bit head. Flushing fluid is introduced to the drilling site through a drill tube attached to the drill bit and debris is flushed from the drilling site via axially extending grooves formed along the sides of the drill bit head. Gauge buttons fixed to the gauge wear heavily since they are subjected to more load than other buttons. The life of such heavily wearing gauge buttons constitutes the effective life of the bit.

The provision of a substantial number of buttons on the gauge can facilitate the drilling process, such as by providing good protection for the peripheral edges and grooves of the drill bit head and thereby maintaining satisfactory flushing of debris.

Moreover, in the area of the axially extending grooves, there is often insufficient space along the gauge to provide a hole for a button and consequently, buttons on the gauge can be more subject to excessive. Therefore it desirable to provide a drill bit that has a relatively high wear volume around its periphery and to provide a drill bit that permits more buttons to be disposed closer to the periphery of the drill bit.

According to an aspect of the present invention, a drill bit for rock drilling tools is provided and comprises a drill bit head having a front surface having a face surface defining a forward-most end of the drill bit head, at least one hole in the drill bit head for receiving a button, and at least one recess in the face surface, the recess being larger than the hole, and the hole being disposed in the recess so that an open end of the hole is disposed below the face surface.

A drilling tool comprising such a drill bit is also provided.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
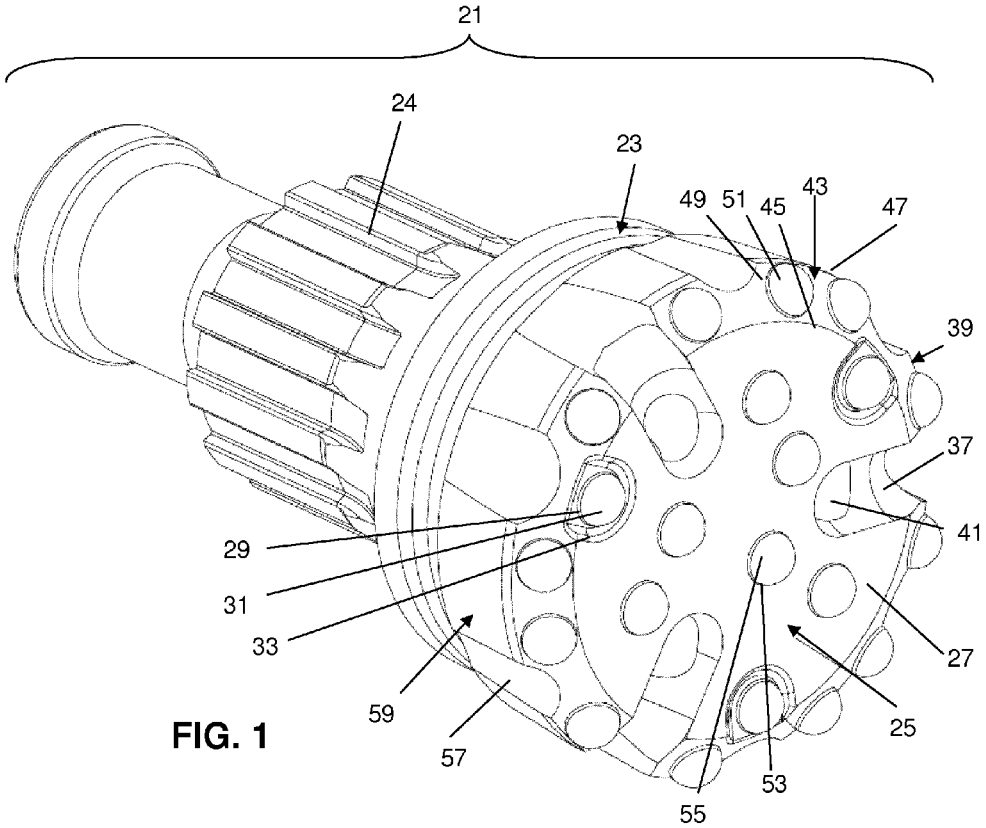
FIG. 1 is a perspective view of a drill bit according to an aspect of the present invention.
Figure 2A:
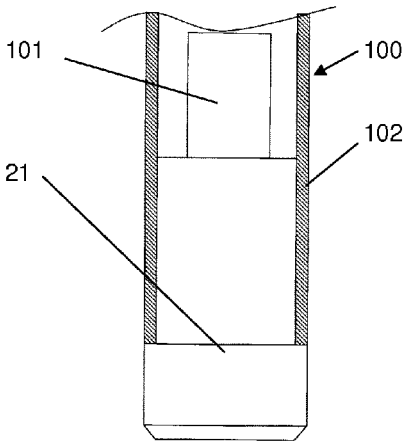
FIG. 2A is a schematic, cross-sectional view of a portion of a down-the-hole hammer type drill according to an aspect of the present invention.
Figure 2B:
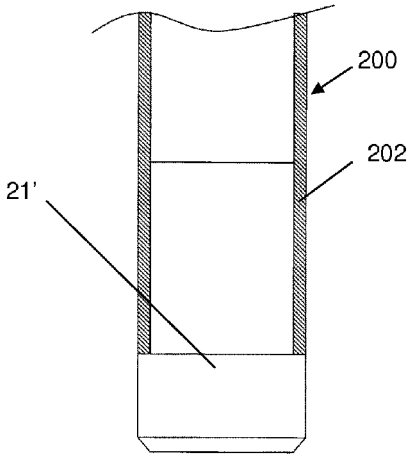
FIG. 2B is a schematic, cross-sectional view of a portion of a top hammer-type rock drill according to an aspect of the present invention.

FIG. 1 shows a drill bit 21 for percussive rock drilling tools. According to an aspect of the invention, the drill bit 21 illustrated can be used in a variety of drilling tools such as down-the-hole hammers 100 (shown schematically in FIG. 2A) wherein a piston 101 in a casing 102 is intended to strike an anvil of the drill bit 21. Drill bits 21' with features similar features of the drill bit 21 but for use with top hammer-type rock drills 200 (shown schematically in FIG. 2B) wherein compressive pulses are delivered to the drill bit 21' via the tube or rod 202 can also be provided according to another aspect of the invention. The following description describes the drill bit 21 intended for use with a down-the-hole hammer, however, it will be appreciated that the description applies equally well to a drill bit such as is used in percussive rock drill applications, except where otherwise indicated.

Figure 3:
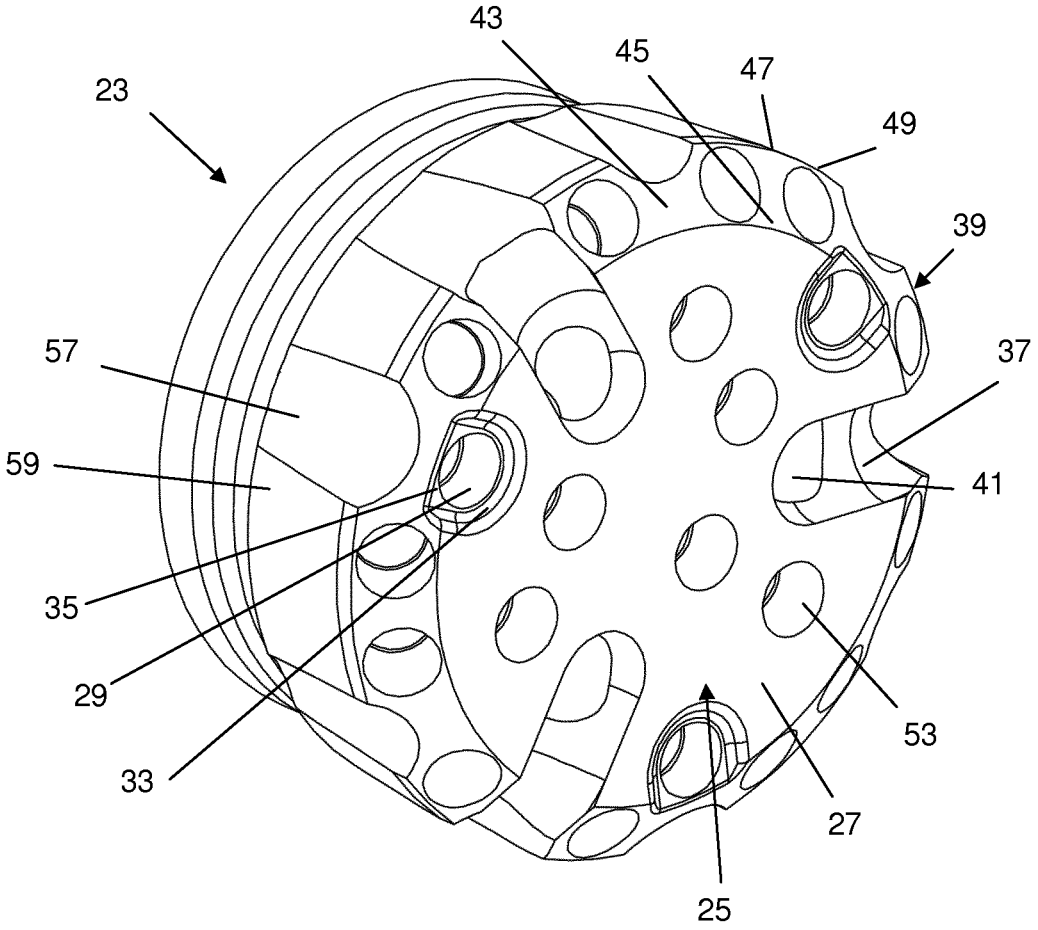
FIG. 3 is a perspective view of a drill bit head without buttons according to FIG. 1.

The drill bit 21 comprises a drill bit head 23 and a shank 24 having what shall be denominated a front surface 25 for purposes of the present invention. FIG. 3 shows the drill bit head 23 not attached to a shank of the drill bit. The front surface 25 has a face surface 27 defining a forward-most end of the drill bit head 23. The face surface 27 is illustrated as being a flat surface, however, it can have other shapes, such as convex or concave, and may comprise several different surfaces. As seen in FIG. 3, at least one hole 29 is provided in the drill bit head 23 for receiving a button 31 (buttons shown in FIG. 1, removed in FIG. 3). The button 31 is ordinarily made of an extremely hard material, such as cemented carbide, while the rest of the drill bit 21 will ordinarily be made of another material, such as steel.

Figure 5A:
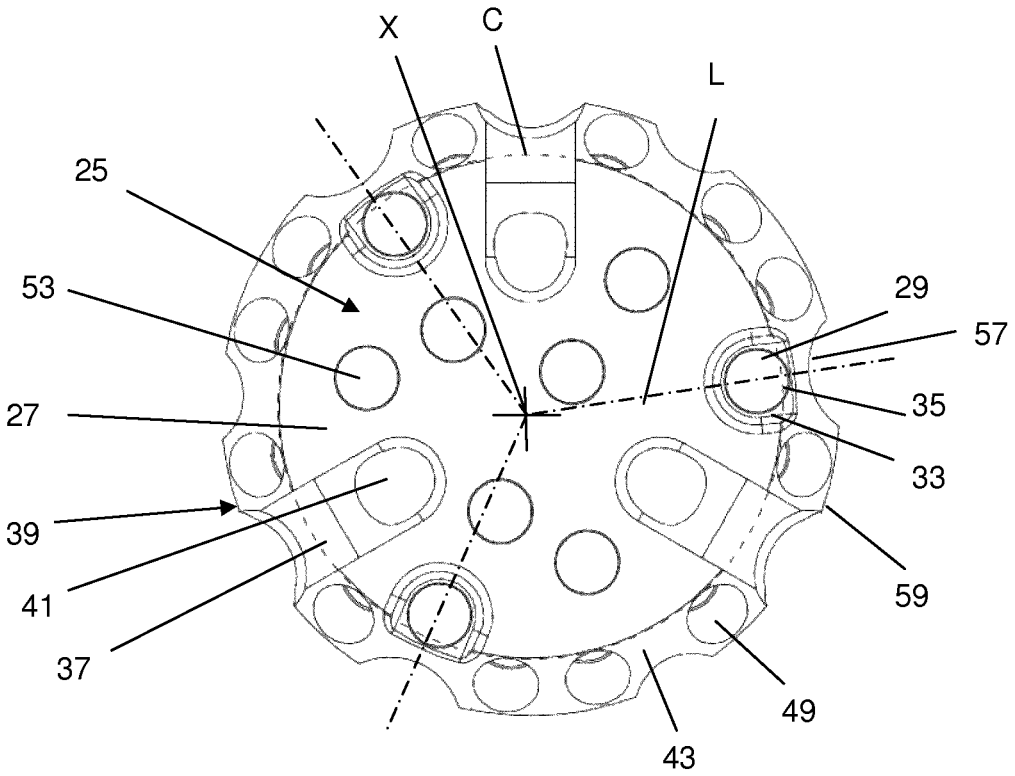
FIGS. 5A and 5B are end views of a drill bit according to an aspect of the present invention showing the drill bit without and with buttons, respectively.
Figure 5B:
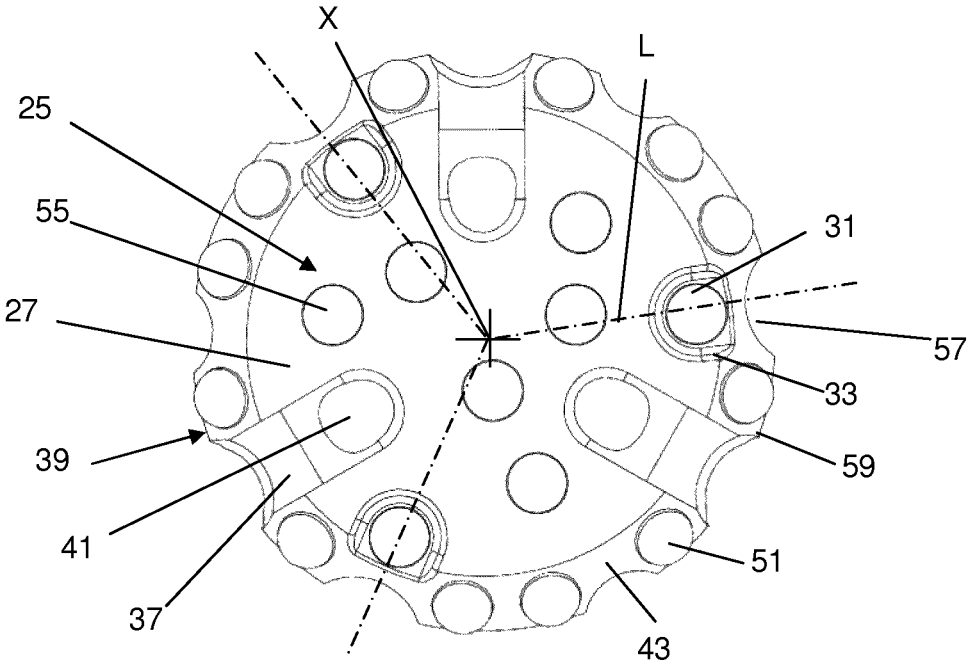

At least one recess 33 is provided in the face surface 27. The recess 33 is larger than the hole 29, and the hole is disposed in the recess so that an open end 35 of the hole is disposed below the face surface 27. In other words, the hole 29 and the button 31 therein can be considered to be "sunken" with respect to the face surface. A radius of the recess 33 when viewed in top view as in FIG. 5B can be about 30 to 100% larger than the button radius. In addition to the at least one hole 29, other holes are ordinarily provided for other buttons but these other holes are not necessarily disposed in recesses.

The drill bit 21 also ordinarily comprises at least one and ordinarily a plurality of flow channels 37 extending from the face surface 27 of the front surface 25 to an outer periphery 39 of the front surface of the drill bit head and, for each flow channel, at least one respective flow opening 41 terminating at the flow channel. Each flow opening 41 extends at least partially through the drill bit head 23 so that the front surface 25 of the drill bit 21 is in flow communication with a space inside the tube 102. Fluid is circulated through the flow channels 37 and flow openings 41.

The plurality of flow channels 37 and flow openings 41 are ordinarily evenly arranged around the circumference of the front surface in the sense that, if there are two flow openings, they are disposed at substantially 180° to each other, if there are three flow openings, they are disposed at substantially 120° to each other, if there are four flow openings, they are disposed at substantially 90° to each other, etc. A plurality of recesses 33 and respective holes 29 are ordinarily provided, with at least one recess being disposed between any two consecutive (in a circumferential direction) flow channels.

The front surface 25 of the drill bit head 23 can comprise a gauge 43 surrounding the face surface 27. The gauge 43 ordinarily has a generally frustoconical shape so that an inner edge 45 of the gauge is disposed closer to the face surface 27 at the forward-most end of the drill bit head 23 than the outer edge 47 of the gauge, with the outer edge ordinarily defining the outer periphery 39 of the front surface 25. Ordinarily, the recess 33 is partially disposed in the gauge 43, as well as being partially disposed in the face surface 27. Ordinarily, the at least one hole 29 is also at least partially disposed in the gauge. An imaginary circle C coinciding with at least major parts of the inner edge 45 intersects in the top view of FIGS. 5A and 5B the hole 29 and the button 31. The gauge 43 is illustrated as being a single frustoconical surface, however, it can have other shapes, such as plural, concentric frustoconical surfaces, or discrete facets.

The drill bit 21 can also comprise at least one gauge hole 49 for receiving a gauge button 51. The gauge hole 49 is disposed entirely in the gauge 33. When there is a plurality of evenly arranged flow channels 37 extending from the face surface 27 of the front surface to the outer periphery 39 of the front surface 25 of the drill bit head 23, there is ordinarily also a plurality of gauge holes 49 and a plurality of recesses 29 with at least one gauge hole and at least one recess disposed between any two consecutive flow channels. Ordinarily, a plurality of gauge holes are provided between each pair of consecutive flow channels 37.

The drill bit 21 typically comprises at least one, ordinarily a plurality of, face surface holes 53 for receiving a face button 55 entirely in the face surface 27. In the embodiment shown in FIG. 4 the drill bit 21 has at least one face surface hole 53 and a face button 55 in the face surface hole, at least one gauge hole 49 and a gauge button 51 in the gauge hole, and the button 31 in the hole 29 in the recess 33. A forward-most point X1 of the button 31 is disposed behind a forward-most point X2 of the face button 55 in a direction of a longitudinal axis X of the drill bit 21 and even with or forward of a forward-most point X3 of the at least one gauge button 51. It should be noted that the hole depths and button heights are reduced in FIG. 4 for illustrative purposes only. Said depths and heights are in practice more extended.

The drill bit 21 typically comprises at least one and ordinarily a plurality of axially extending grooves 57 in an external surface 59 of the drill bit, usually to facilitate flushing of debris from a hole being drilled. The grooves 57 extend to the front surface 25, typically terminating at the gauge 43. As seen, for example, in FIGS. 5A and 5B, there is ordinarily not enough material in the gauge 43 in the vicinity of each of these grooves 57 to provide a gauge hole 49 and a gauge button 51. However, by providing a recess 33 so that it is disposed on a radial line L that extends between a corresponding one of the grooves 57 and a longitudinal axis X of the drill bit 21, the hole 29 can be positioned close to the outer periphery 39 of the front surface 25, and the forward-most point X1 of the button 31 can be disposed at or near the level of the forward-most point X3 of the gauge buttons 51 in the longitudinally axial direction of the drill bit.

Figure 4:
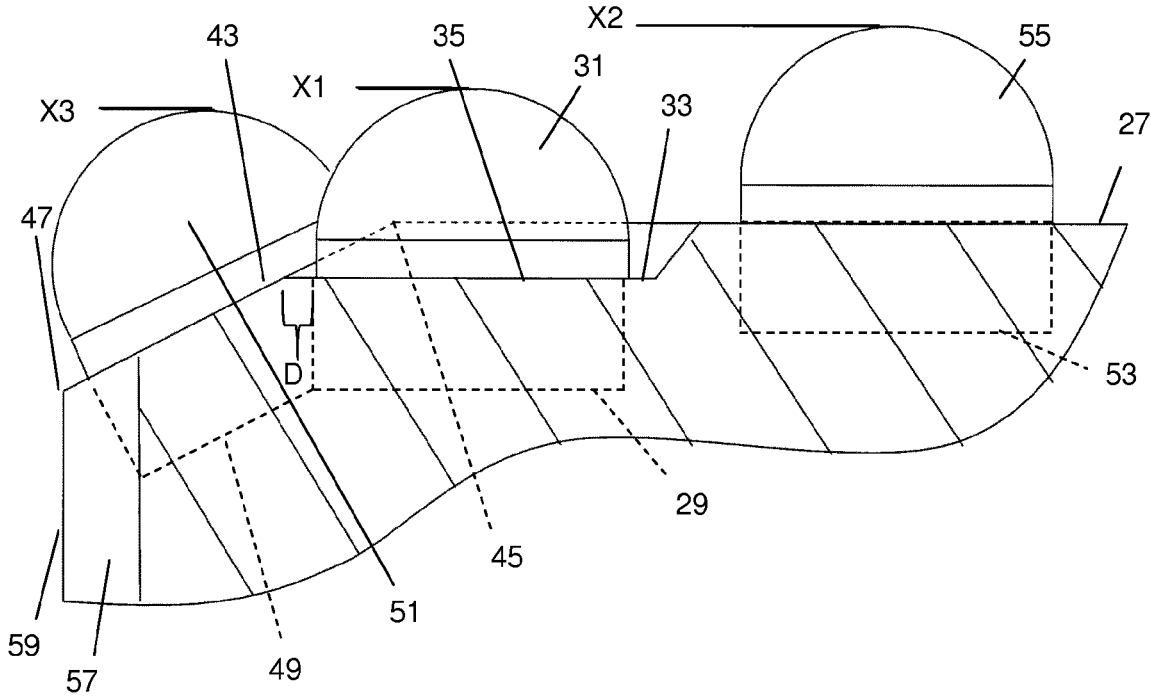
FIG. 4 is a cross-sectional view of a portion of a drill bit according to an aspect of the present invention.

If a regular face surface hole were formed along an intersection of the gauge and the face surface, there would be insufficient material to support a button in the hole. By providing the recess 33, a hole 29 having a central axis in the direction of the face button holes 53 can be located in the recess and formed so that there is good support for the button 31 around the entire button. As seen in FIG. 4, the hole 29 can be positioned in a recess 33 so that the top end 35 of the hole is entirely spaced radially inwardly a distance D from the gauge 43 so that the entire periphery of the button 31 is supported by the same amount of material. Additionally, the height of the button 31 relative to the height of the gauge buttons 51 can be adjusted as desired by adjusting the depth and location of the recess.

By providing the recess 33, hole 29, and button 31 closer to the outer periphery of the drill bit head 23 than would have been possible without the recess, more peripheral wear volume, comprising for example cemented carbide, can be provided because buttons that would have otherwise been located on the face surface 27 are closer to the edge. The configuration of the recess 33 facilitates flushing of the front surface 25 of the drill bit head 23 as well.

There are numerous advantages with a drill bit according to the present invention having more buttons located close to the row of gauge buttons. The useful crushing work is shared by the gauge buttons and the sunken buttons such that the life of the drill bit is improved. Also, the provision of recesses having holes carrying buttons 31 therein improves the flushing of the face to maintain the penetration rate at a high level during drilling.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

The disclosures in EP Patent Application No. 11186861.8, from which this application claims priority, are incorporated herein by reference.

What is claimed is:

1. A drill bit for percussive rock drilling tools, comprising: a drill bit head having a longitudinal axis and a front surface including a face surface defining a forward-most end of the drill bit head;

at least one hole located in the drill bit head and a button located in the at least one hole;

at least one face surface hole disposed in the face surface of the drill bit head, a face button being located in the face surface hole;

at least one recess disposed in the face surface, the at least one recess being larger than the at least one hole, the at least one hole being disposed in the at least one recess so that an open end of the at least one hole is disposed below the face surface, the drill bit head including a gauge surrounding the face surface, wherein the at least one recess and the at least one hole are partially disposed in the gauge and partially disposed in the face surface; and at least one gauge hole disposed in the gauge and a gauge button located in the at least one gauge hole, a center of the at least one gauge hole being radially further from the longitudinal axis than a center of the at least one recess and a center of the at least one hole disposed in the recess, a forward-most point of the button being disposed behind a forward-most point of the face button in a direction of the longitudinal axis of the drill bit and even with or forward of a forward-most point of the gauge button.

2. The drill bit for percussive rock drilling tools as set forth in claim 1, further comprising at least one flow opening extending at least partially through the drill bit head.

3. The drill bit for percussive rock drilling tools as set forth in claim 2, further comprising at least one flow channel extending from the face surface of the front surface to an outer periphery of the front surface of the drill bit head and for each flow channel, a respective one of the at least one flow opening terminating at the respective flow channel.

4. The drill bit for percussive rock drilling tools as set forth in claim 3, further comprising a plurality of flow channels and respective flow openings.

5. The drill bit for percussive rock drilling tools as set forth in claim 4, wherein the plurality of flow channels are evenly arranged around the front surface.

6. The drill bit for percussive rock drilling tools as set forth in claim 4, wherein a plurality of the at least one recess are provided, at least one of the plurality of recesses being disposed between any two consecutive flow channels.

7. The drill bit for percussive rock drilling tools as set forth in claim 1, further comprising a plurality of gauge holes disposed in the gauge and a plurality of flow channels extending from the face surface of the front surface to an outer periphery of the front surface of the drill bit head and evenly arranged around the front surface and, for each of the plurality of flow channels, at least one respective flow opening terminates at a respective flow channel, wherein the plurality of gauge holes and a plurality of the at least one recess are provided, the at least one gauge hole and the at least one recess being disposed between any two consecutive flow channels.

8. The drill bit for percussive rock drilling tools as set forth in claim 1, further comprising at least one axially extending groove in an external surface of the drill bit, the at least one groove extending to the front surface, the at least one recess being disposed on a radial line that extends between the groove and a longitudinal axis of the drill bit.

9. The drill bit for percussive rock drilling tools as set forth in claim 1, wherein an imaginary circle coinciding with at least a major part of an inner edge of the gauge intersects the at least one hole and the button.

10. A drilling tool having a drill bit for percussive rock drilling tools, the drill bit comprising:

a drill bit head having a longitudinal axis and a front surface including a face surface defining a forward-most end of the drill bit head;

at least one hole in the drill bit head and a button located in the at least one hole;

at least one face surface hole disposed in the face surface of the drill bit head, a face button being located in the face surface hole;

at least one recess located in the face surface, the at least one recess being larger than the at least one hole, the at least one hole being disposed in the at least one recess so that an open end of the at least one hole is disposed below the face surface, the drill bit head including a gauge surrounding the face surface, wherein the at least one recess and the at least one hole are partially disposed in the gauge and partially disposed in the face surface; and at least one gauge hole disposed in the gauge and a gauge button located in the at least one gauge hole, a center of the at least one gauge hole being radially further from the longitudinal axis than a center of the at least one recess and a center of the at least one hole disposed in the recess, a forward-most point of the button being disposed behind a forward-most point of the face button in a direction of the longitudinal axis of the drill bit and even with or forward of a forward-most point of the gauge button.

* * * * *